US012751492B2

(12) United States Patent
Qiu

(10) Patent No.: US 12,751,492 B2
(45) Date of Patent: Oct. 6, 2026

(54) ATOMIZER AND AEROSOL GENERATING DEVICE

(71) Applicant: CHANGZHOU PATENT ELECTRONIC TECHNOLOGY CO., LTD, Changzhou (CN)

(72) Inventor: Weihua Qiu, Changzhou (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 418 days.

(21) Appl. No.: 18/393,740

(22) Filed: Dec. 22, 2023

(65) Prior Publication Data

US 2024/0114971 A1 Apr. 11, 2024

Related U.S. Application Data

(63) Continuation-in-part of application No. PCT/CN2022/081319, filed on Mar. 17, 2022.

(30) Foreign Application Priority Data

Jun. 24, 2021 (CN) ..... 202121422230.9

(51) Int. Cl.

| | |
|---|---|
| ***A24F 47/00*** | (2020.01) |
| ***A24F 40/10*** | (2020.01) |
| ***A24F 40/42*** | (2020.01) |
| ***A24F 40/485*** | (2020.01) |

(52) U.S. Cl.

CPC ..... *A24F 40/485* (2020.01); *A24F 40/10* (2020.01); *A24F 40/42* (2020.01)

(58) Field of Classification Search

CPC ..... A24F 40/10; A24F 40/42; A24F 40/485

See application file for complete search history.

(56) References Cited

U.S. PATENT DOCUMENTS

2020/0275712 A1* 9/2020 Xiao ..... F16J 15/104

FOREIGN PATENT DOCUMENTS

| | | | |
|---|---|---|---|
| CN | 210960427 | U | 7/2020 |
| CN | 212164888 | U | 12/2020 |
| CN | 212279893 | U | 1/2021 |
| CN | 112353008 | A | 2/2021 |

(Continued)

OTHER PUBLICATIONS

CN 112617290 Translation (Year: 2021).*

*Primary Examiner* — Eric Yaary

(74) *Attorney, Agent, or Firm* — Andrew C. Cheng

(57) ABSTRACT

An atomizer and an aerosol generating device are provided. An atomizing assembly and a sealing seat are provided in an accommodating cavity of a liquid storage member, and the atomizing assembly is supported on the sealing seat, so that the portion of the interior of the liquid storage member other than the atomizing assembly and the sealing seat defines a liquid storage cavity, and an atomizing cavity is provided inside the atomizing assembly. The liquid storage cavity is communicated with the atomizing cavity through a liquid inlet hole. An air inlet hole is formed on the liquid storage member, and an air inlet passage that communicates the atomizing cavity with the air inlet hole is formed on the sealing seat. Before the aerosol generating device is put into use, the air inlet passage is sealed by a plugging assembly.

16 Claims, 13 Drawing Sheets

(56) References Cited

FOREIGN PATENT DOCUMENTS

| | | | | | |
|---|---|---|---|---|---|
| CN | 112617290 | A | * | 4/2021 | ..... A24F 40/40 |
| CN | 213404848 | U | | 6/2021 | |
| CN | 215936292 | U | | 3/2022 | |
| WO | 2017185292 | A1 | | 11/2017 | |
| WO | 2020259692 | A1 | | 12/2020 | |

* cited by examiner

ATOMIZER AND AEROSOL GENERATING DEVICE

CROSS-REFERENCE TO RELATED APPLICATIONS

The present disclosure is a continuation-in-part of International Patent Application No. PCT/CN2022/081319, filed on Mar. 17, 2022, which claims priority to Chinese Patent Application No. 202121422230.9, filed on Jun. 24, 2021. All of the aforementioned patent applications are hereby incorporated by reference in their entireties.

TECHNICAL FIELD

The present disclosure relates to the technical field of simulated smoking, in particular to an atomizer and an aerosol generating device.

BACKGROUND

The aerosol generating device is a relatively common electronic product that simulates cigarettes. It mainly includes an atomizer that can heat and atomize the aerosol-forming substrate to form smoke and a power supply device that supplies power to the atomizer. Specifically, the atomizer is generally provided with an air inlet hole that is communicated with the atomizing cavity of the atomizer to allow external air to enter the atomizing cavity. Currently, during the transportation of aerosol generating devices or before sale, the aerosol-forming substrate stored inside the atomizer is prone to leakage through the air inlet hole, which not only causes pollution and waste of the aerosol-forming substrate, but also causes a lot of inconvenience to the transportation, storage, sale, and use of the aerosol generating device.

SUMMARY

Based on the above problems in the prior art, one purpose of embodiments of the present disclosure is to provide an atomizer that seals the air inlet passage through a plugging assembly to prevent the aerosol-forming substrate from leaking through the air inlet hole before the aerosol generating device is put into use.

In order to achieve the above purpose, the technical solution adopted by this disclosure is to provide an atomizer for an aerosol generating device, including:

a liquid storage member having an accommodating cavity therein, wherein the liquid storage member is provided with a smoke outlet;

a sealing seat disposed in the accommodating cavity;

an atomizing assembly configured to atomize an aerosol-forming substrate to form smoke that can be inhaled by a user, wherein the atomizing assembly is disposed in the accommodating cavity, and the atomizing assembly is supported on the sealing seat, so that the portion of the interior of the liquid storage member other than the atomizing assembly and the sealing seat defines a liquid storage cavity for storing the aerosol-forming substrate, an atomizing cavity that is separated from the liquid storage cavity is provided inside the atomizing assembly, the atomizing assembly is provided with a liquid inlet hole that communicates the liquid storage cavity with the atomizing cavity, the atomizing cavity is communicated with the smoke outlet, the liquid storage member is further provided with an air inlet hole, the sealing seat is provided with an air inlet passage that communicates the atomizing cavity with the air inlet hole; and a plugging assembly configured to seal the air inlet passage before the aerosol generating device is put into use.

Further, the plugging assembly includes a sealing member slidably disposed in the air inlet passage along an axial direction of the air inlet passage and a pulling member configured for pulling the sealing member to remove the sealing member away from the air inlet passage, one end of the pulling member is connected to the sealing member, the liquid storage member is correspondingly provided with an opening for the other end of the pulling member to pass through, and the other end of the pulling member passes through the opening to extend to the outside of the liquid storage member.

Further, the pulling member is a pulling rod, the pulling rod includes a long rod section extending to the outside of the liquid storage member and a connecting section connecting the long rod section with the sealing member.

Further, the diameter of the connecting section is smaller than the diameter of the long rod section.

Further, the liquid storage member includes a main housing having the accommodating cavity and a bottom seat installed at a bottom opening of the main housing, the smoke outlet is formed at the top end of the main housing, the sealing seat is supported on one side of the bottom seat facing the accommodating cavity, a vent tube that communicates the atomizing cavity with the smoke outlet is provided in the main housing, the portion of the interior of the main housing other than the atomizing assembly, the sealing seat and the vent tube defines the liquid storage cavity, the air inlet hole is provided on the bottom seat, the atomizing assembly includes an atomizing cover with an open end supported on the sealing seat, the plugging assembly includes a sealing member slidably disposed in the air inlet passage and a pulling member configured for pulling the sealing member along an axial direction of the atomizing cover to remove the sealing member away from the air inlet passage, one end of the pulling member is connected to the sealing member, the bottom seat is correspondingly provided with an opening for the other end of the pulling member to pass through, and the other end of the pulling member passes through the opening to extend to the outside the main housing.

Further, the atomizing assembly further includes an atomizing core for generating heat to heat the aerosol-forming substrate when energized, the inner cavity of the atomizing cover forms the atomizing cavity, the atomizing core is disposed in the atomizing cavity, a closed end of the atomizing cover is provided with a smoke guiding hole, the inner cavity of the vent tube forms a smoke guiding passage that communicates the smoke guiding hole with the smoke outlet, the portion of the interior of the main housing other than the atomizing cover, the sealing seat and the vent tube defines the liquid storage cavity, the liquid inlet hole is provided on the side wall of the atomizing cover, the outer contour of the atomizing cover is in a tubular shape, the axial direction of the air inlet passage is parallel to the axial direction of the atomizing cover, a first port of the air inlet passage is communicated with the atomizing cavity, a first groove for accommodating the sealing member is provided on one side of the bottom seat facing the sealing seat, the first groove communicates the air inlet hole with a second port of the air inlet passage.

Further, a vent groove is provided on the sealing seat adjacent to the second port of the air inlet passage.

Further, a protrusion is provided on the bottom seat corresponding to the position of the air inlet passage, the protrusion is located in the first groove, so that the portion of the first groove other than the protrusion forms a liquid reservoir, the opening is provided on the protrusion, the axial direction of the opening is parallel to the axial direction of the atomizing cover, the protrusion is further recessed to form a positioning groove for accommodating and positioning the sealing member, the positioning groove is communicated with the opening.

Further, one side of the sealing member facing the atomizing cover is recessed to form a second groove.

Further, after the sealing member is removed away from the air inlet passage, the height of the top open end of the air inlet hole is higher than the height of the top open end of the second groove in the direction from the bottom seat to the smoke outlet.

Further, the sealing member is provided with a stopping projection for restricting the movement of the sealing member.

Based on the above problems in the prior art, another purpose of the embodiments of the present disclosure is to provide an aerosol generating device with the atomizer provided in any of the above-mentioned solutions.

In order to achieve the above purpose, the technical solution adopted by this disclosure is to provide an aerosol generating device, including an atomizer for atomizing an aerosol-forming substrate and a power supply device for supplying power to the atomizer, wherein the atomizer is the atomizer provided in any of the above solutions.

Compared with the prior art, one or more of the above technical solutions in the embodiments of the present disclosure have at least one of the following beneficial effects:

In the atomizer and aerosol generating device provided in the embodiments of the present disclosure, the atomizing assembly and the sealing seat are disposed in the accommodating cavity of the liquid storage member of the atomizer, the atomizing assembly is supported on the sealing seat, so that the portion of the interior of the liquid storage member other than the atomizing assembly and the sealing seat defines a liquid storage cavity, an atomizing cavity that is separated from the liquid storage cavity is provided inside the atomizing assembly, the atomizing assembly is further provided with a liquid inlet hole that communicates the liquid storage cavity with the atomizing cavity, the liquid storage member is provided with an air inlet hole, and the sealing seat is provided with an air inlet passage that communicates the atomizing cavity with the air inlet hole. Thus, before the aerosol generating device is put into use, it is only required to seal the air inlet passage using the plugging assembly, to block the communication between the atomizing cavity of the atomizer and the air inlet hole of the liquid storage member, which can effectively prevent the aerosol-forming substrate stored in the liquid storage cavity from leaking through the air inlet hole, thereby facilitating the transportation of the aerosol generating device. In this way, it may avoid pollution and waste of the leaking aerosol-forming substrate, and it may also avoid short-circuit damage to electronic components inside a battery caused by liquid leakage from the air inlet hole of the atomizer.

BRIEF DESCRIPTION OF THE DRAWINGS

In order to explain the technical solutions in the embodiments of the present disclosure more clearly, the drawings that need to be used in the description of the embodiments or prior art will be briefly introduced below. Obviously, the drawings in the following description are only some embodiments of the present disclosure, for those of ordinary skill in the art, other drawings can be obtained based on these drawings without exerting any creative effort.

Specifically, the reference signs in the figures are.

Figure 1:
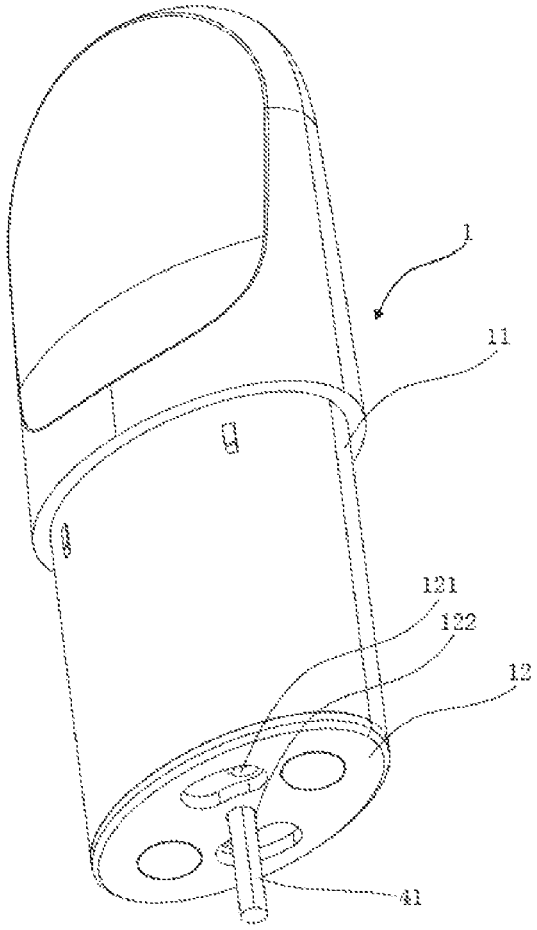
FIG. 1 is a schematic three-dimensional structural diagram of an atomizer provided in an embodiment of the present disclosure.
Figure 2:
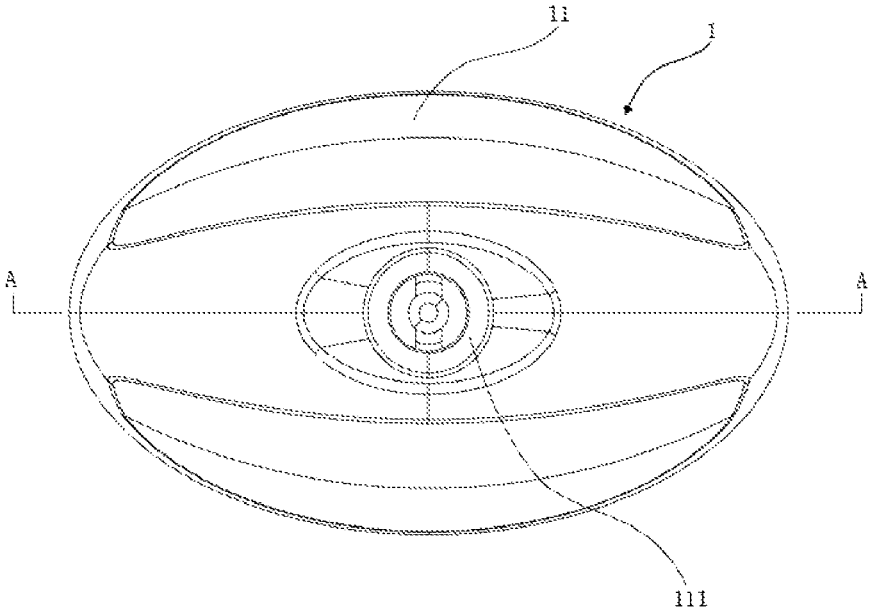
FIG. 2 is a schematic top view of the atomizer provided in the embodiment of the present disclosure.

| | |
|---|---|
| liquid storage member 1 | positioning hole 33 |
| main housing 11 | plugging assembly 4 |
| smoke outlet 111 | sealing member 41 |
| bottom opening 112 | annular resisting protrusion 411 |
| bottom seat 12 | second groove 412 |
| air inlet hole 121 | stopping projection 413 |
| opening 122 | pulling member 42 |
| first groove 123 | long rod section 421 |

-continued

| | |
|---|---|
| protrusion 124 | connecting section 422 |
| positioning groove 125 | liquid storage cavity 5 |
| vent tube 13 | atomizing cavity 6 |
| smoke guiding passage 14 | power supply device 7 |
| connecting tube 15 | sealing sleeve 8 |
| atomizing assembly 2 | first sleeve section 81 |
| atomizing cover 21 | annular sleeve section 82 |
| liquid inlet hole 211 | second sleeve section 83 |
| smoke guiding hole 212 | first step surface 84 |
| atomizing core 22 | second step surface 85 |
| heating wire 221 | third step surface 86 |
| liquid guiding member 222 | first annular protrusion 87 |
| sealing seat 3 | second annular protrusion 88 |
| air inlet passage 31 | third annular protrusion 89 |
| first port 311 | aerosol-forming substrate 9 |
| second port 312 | injection liquid level 10 |
| vent groove 32 | |

DETAILED DESCRIPTION OF PREFERRED EMBODIMENTS

In order to make the technical problems, technical solutions and beneficial effects to be solved by this disclosure more clear, the disclosure will be further described in detail below with reference to the accompanying drawings and embodiments. It should be understood that the specific embodiments described here are only configured to explain the present disclosure and are not intended to limit the present disclosure.

It should be noted that when an element is referred to as being "connected to/with" or "disposed in/on" another element, it can be directly on the other element or indirectly on the other element. When an element is referred to as being "connected to/with" another element, it can be directly connected to the other element or indirectly connected to the other element.

In the description of the present disclosure, it should be noted that, unless otherwise explicitly stipulated and limited, the terms "installed", "mounted" and "connected" should be understood in a broad sense. For example, it can be a fixed connection, a detachable connection, or an integral connection; it can be a mechanical connection or an electrical connection; it can be directly connected or indirectly connected through an intermediate element; it can be the internal connection between two elements or the interaction between two elements. For those of ordinary skill in the art, the specific meanings of the above terms in the present disclosure can be understood according to specific circumstances.

It should be understood that the orientations or positional relationships indicated by the terms "length", "width", "upper", "lower", "front", "back", "left", "right", "vertical", "horizontal", "top", "bottom", "inner", "outside", etc. are based on the orientations or positional relationships shown in the accompanying drawings. This is only for the convenience of describing the present disclosure and simplifying the description, and does not indicate or imply that the device or element referred to must have a specific orientation, be constructed and operated in a specific orientation. Therefore, it cannot be understood as a limitation of the present disclosure.

Reference throughout this specification to "an embodiment" or "embodiment" means that a specific feature, structure or characteristic described in connection with the embodiment is included in at least one embodiment of the present application. Thus, the phrases "in one embodiment," "in some embodiments," or "in some of these embodiments" appear in various places throughout this specification, and not all are referring to the same embodiment. In addition, the specific features, structures, or characteristics can be combined in any suitable manner in one or more embodiments.

Please refer to FIG. 1 to FIG. 12 together, an atomizer provided in an embodiment of the present disclosure is described. The atomizer provided in the embodiment of the present disclosure is suitable for an aerosol generating device. The aerosol generating device can start working by electrically driving the atomizer through its power supply device 7, the atomizer can atomize the aerosol-forming substrate to form smoke for the user to inhale to achieve the effect of simulating smoking. Please refer to FIG. 1, FIG. 3 and FIG. 4 together, the atomizer provided in the embodiment of the present disclosure includes a liquid storage member 1, an atomizing assembly 2, a sealing seat 3, and a plugging assembly 4. The liquid storage member 1 has an accommodating cavity therein. The atomizing assembly 2 can atomize the aerosol-forming substrate to form smoke that can be inhaled by the user. The sealing seat 3 and the atomizing assembly 2 are disposed in the accommodating cavity of the liquid storage member 1, and the atomizing assembly 2 is supported on the sealing seat 3, so that the portion of the interior of the liquid storage member 1 other than the atomizing assembly 2 and the sealing seat 3 defines a liquid storage cavity 5 for storing the aerosol-forming substrate. An atomizing cavity 6 that is separated from the liquid storage cavity 5 is provided inside the atomizing assembly 2. The atomizing assembly 2 is further provided with a liquid inlet hole 211 that communicates the liquid storage cavity 5 with the atomizing cavity 6. The aerosol-forming substrate in the liquid storage cavity 5 can flow into the atomizing cavity 6 through the liquid inlet hole 211, and the aerosol-forming substrate entering the atomizing cavity 6 can be heated and atomized by the atomizing core 22 in the atomizing cavity 6 to form smoke. Furthermore, please refer to FIG. 3, FIG. 4 and FIG. 10 together, the liquid storage member 1 is provided with a smoke outlet 111 that is communicated with the atomizing cavity 6. The liquid storage member 1 is further provided with an air inlet hole 121 that is communicated with the atomizing cavity 6. The sealing seat 3 is provided with an air inlet passage 31 that communicates the atomizing cavity 6 with the air inlet hole 121. Please also refer to FIG. 3, the plugging assembly 4 can seal the air inlet passage 31 during the transportation or before sale of the aerosol generating device, to block the communication between the atomizing cavity 6 of the atomizer and the air inlet hole 121 of the liquid storage member 1, which can effectively prevents the aerosol-forming substrate stored in the liquid storage cavity 5 of the atomizer from leaking through the air inlet hole 121. Please also refer to FIG. 4, when using the aerosol generating device, it is only needed to use an external force to remove the sealing of the plugging assembly 4 away from the air inlet passage 31, that is, the air inlet passage 31 is opened, so that the atomizing cavity 6 of the atomizer is communicated with the air inlet hole 121 of the liquid storage member 1. Thus, when using the aerosol generating device to simulate smoking, the aerosol-forming substrate in the liquid storage cavity 5 of the liquid storage member 1 flows into the atomizing cavity 6 through the liquid inlet hole 211, the aerosol-forming substrate entering the atomizing cavity 6 is atomized by the atomizing core 22 of the atomizing assembly 2 to form an aerosol, the user only needs to suck through the smoke outlet 111. The external air flows into the atomizing cavity 6 through the air inlet hole 121 and the air inlet passage 31 in sequence, and mixes with the atomized aerosol-forming substrate to form smoke that can be inhaled by the user. The smoke flows out through the smoke outlet 111 with a negative pressure airflow generated by the suction, and the user can inhale the smoke through the smoke outlet 111 to achieve the effect of simulating smoking.

Compared with the prior art, in the atomizer provided in the embodiment of the present disclosure, the atomizing assembly 2 and the sealing seat 3 are disposed in the accommodating cavity of the liquid storage member 1, the atomizing assembly 2 is supported on the sealing seat, so that the portion of the interior of the liquid storage member 1 other than the atomizing assembly 2 and the sealing seat 3 defines the liquid storage cavity 5, an atomizing cavity 6 that is separated from the liquid storage cavity 5 is provided inside the atomizing assembly 2, the atomizing assembly 2 is further provided with a liquid inlet hole 211 that communicates the liquid storage cavity 5 with the atomizing cavity 6, the liquid storage member 1 is provided with an air inlet hole 121, and the sealing seat 3 is provided with an air inlet passage 31 that communicates the atomizing cavity 6 with the air inlet hole 121. Thus, during the transportation and before sale or use of the aerosol generating device, it is only required to seal the air inlet passage 31 using the plugging assembly 4, to block the communication between the atomizing cavity 6 of the atomizer and the air inlet hole 121 of the liquid storage member 1, which can effectively prevent the aerosol-forming substrate stored in the liquid storage cavity 5 from leaking through the air inlet hole 121, thereby facilitating the transportation of the aerosol generating device. In this way, it may avoid pollution and waste caused by liquid leakage from the air inlet hole 121 of the atomizer, and it may also avoid short-circuit damage to electronic components inside a battery caused by liquid leakage from the air inlet hole 121 of the atomizer.

Figure 3:
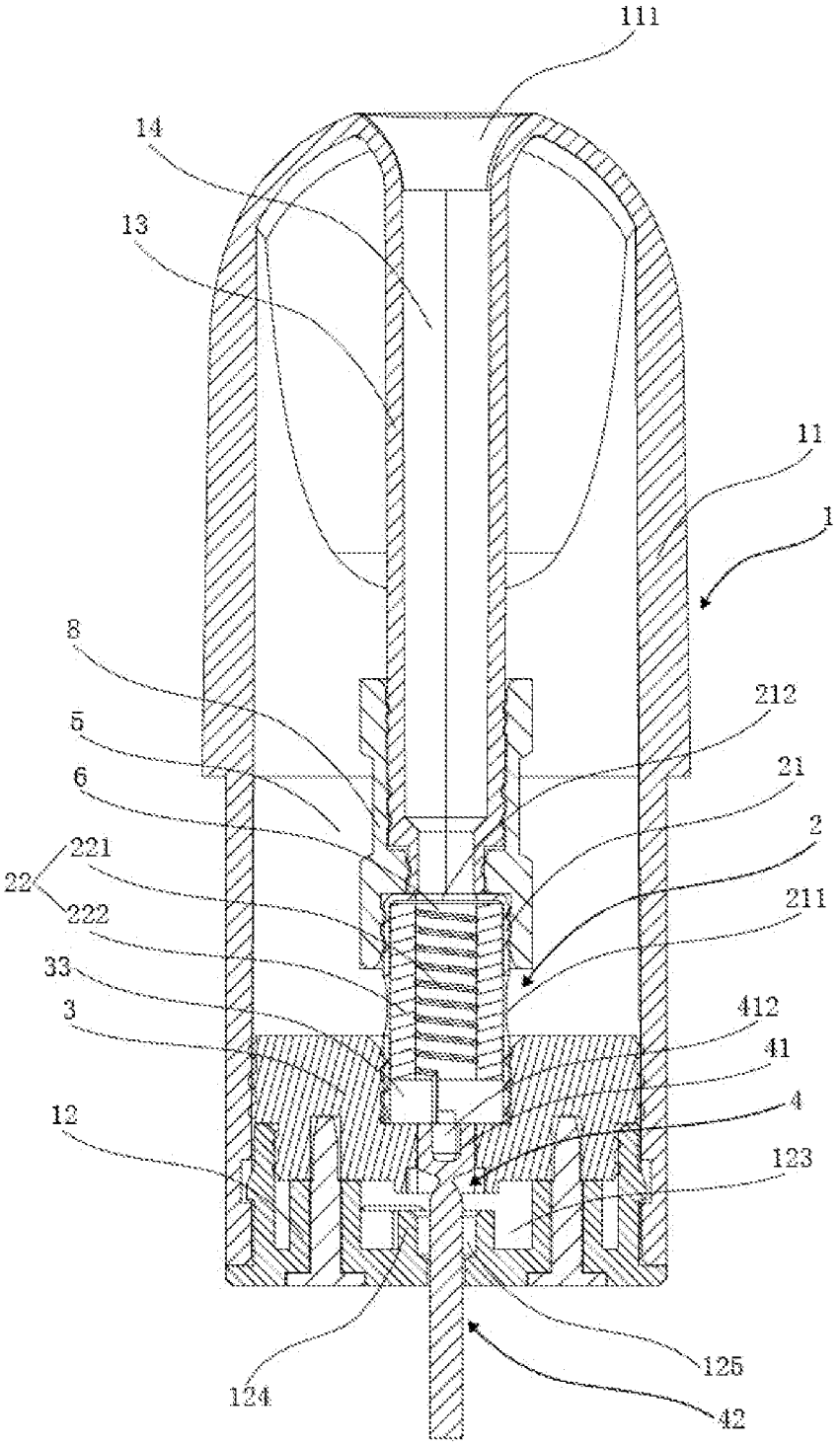
FIG. 3 is a schematic cross-sectional structural diagram along line A-A in FIG. 2.
Figure 6:
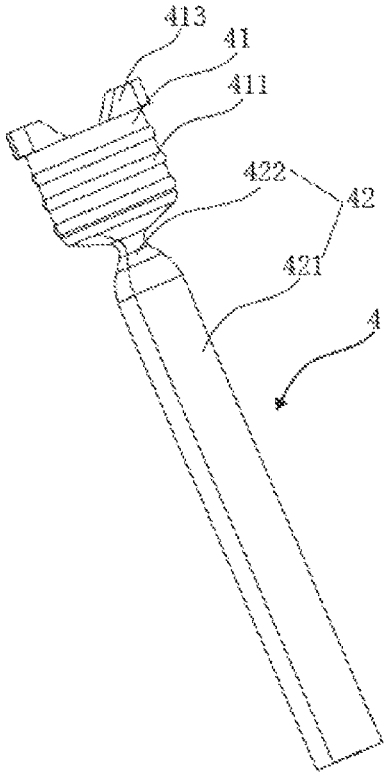
FIG. 6 is a schematic three-dimensional structural diagram of a plugging assembly provided in the embodiment of the present disclosure.
Figure 9:
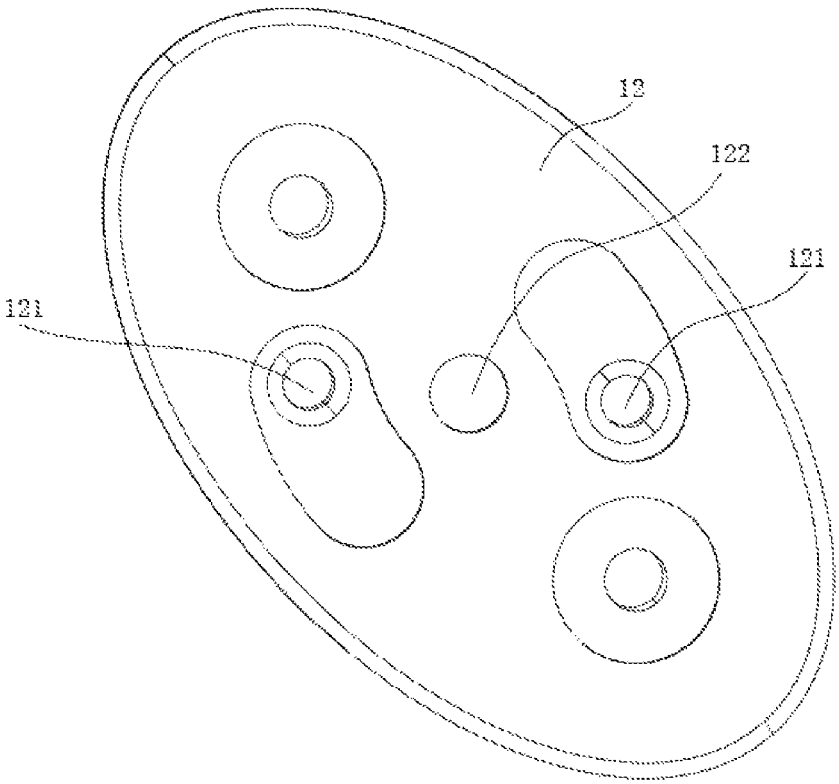
FIG. 9 is another schematic three-dimensional structural diagram of the bottom seat provided in the embodiment of the present disclosure.

Please refer to FIG. 3, FIG. 6 and FIG. 9 together, in some embodiments, the plugging assembly 4 includes a sealing member 41 slidably disposed in the air inlet passage 31 along an axial direction of the air inlet passage 31, and a pulling member 42 configured for pulling the sealing member 41 to remove the sealing member 41 away from the air inlet passage 31. One end of the pulling member 42 is connected to the sealing member 41, and the liquid storage member 1 is correspondingly provided with an opening 122 for the other end of the pulling member 42 to pass through. The other end of the pulling member 42 passes through the opening 122 to extend to the outside the liquid storage member 1. By adopting the above solution, when using the aerosol generating device, the user only needs to pull the sealing member 41 through the pulling member 42, so that the sealing member 41 is removed away from the air inlet passage 31. Thus, the sealing of the air inlet passage 31 by the plugging assembly 4 can be quickly and conveniently removed, to enable the atomizing cavity 6 of the atomizer to be communicated with the air inlet hole 121 of the liquid storage member 1. When using the aerosol generating device to simulate smoking, the aerosol-forming substrate in the liquid storage cavity 5 of the liquid storage member 1 flows into the atomizing cavity 6 through the liquid inlet hole 211, the aerosol-forming substrate entering the atomizing cavity 6 is atomized by the atomizing core 22 of the atomizing assembly 2 to form an aerosol, the user only needs to suck through the smoke outlet 111. The external air flows into the atomizing cavity 6 through the air inlet hole 121 and the air inlet passage 31 in sequence, and mixes with the atomized aerosol-forming substrate to form smoke that can be inhaled by the user. The smoke flows out through the smoke outlet 111 with a negative pressure airflow generated by the suction, and the user can inhale the smoke through the smoke outlet 111 to achieve the effect of simulating smoking. It can be understood that the sealing member 41 can be a columnar or block-shaped sealing silicone member that is completely and slidably disposed in the air inlet passage 31. The sealing member 41 can also be a sealing silicone plug that is at least partially disposed in one end port of the air inlet passage 31. Of course, the sealing member 41 can be, but is not limited to, a sealing silicone member or a sealing silicone plug. For example, the sealing member 41 can also be a sealing rubber member or a sealing rubber plug.

Please refer to FIG. 3 and FIG. 6 together, in some embodiments, the pulling member 42 is in a long rod shape to facilitate pulling the sealing member 41. It can be understood that the pulling member 42 can be, but is not limited to, a pulling rod. For example, the pulling member 42 can also be a pulling cord or a pulling tab that can pull the sealing member 41 to remove the sealing member 41 away from the air inlet passage 31. When the pulling member 42 is a long rod-shaped pulling rod, the pulling rod includes a long rod section 421 extending to the outside of the liquid storage member 1 and a connecting section 422 connecting the long rod section 421 with the sealing member 41. The connecting section 422 is made of a flexible material such that the long rod section 421 can be easily separated from the sealing member 41, and the length of the long rod section 421 is much longer than the connecting section 422. By adopting the above solution, the user only needs to pull the sealing member 41 through the long rod section 421 extending out of the liquid storage member 1, so that the sealing member 41 is removed away from the air inlet passage 31. Thus, the sealing of the air inlet passage 31 by the plugging assembly 4 can be quickly and conveniently removed, to enable the atomizing cavity 6 of the atomizer to be communicated with the air inlet hole 121 of the liquid storage member 1. At this time, the user only needs to manually pull apart the long rod section 421 connected to the sealing member 41, the atomizer can be conveniently assembled on the power supply device 7 for use, which is convenient to operate, simple and practical, thereby preventing the long rod section 421 from interfering with the assembly between the atomizer and the power supply device 7.

Please refer to FIG. 3 and FIG. 6 together, in some embodiments, the diameter of the connecting section 422 is smaller than the diameter of the long rod section 421, which is helpful for the user to quickly pull apart the long rod section 421 connected to the sealing member 41.

Figure 7:
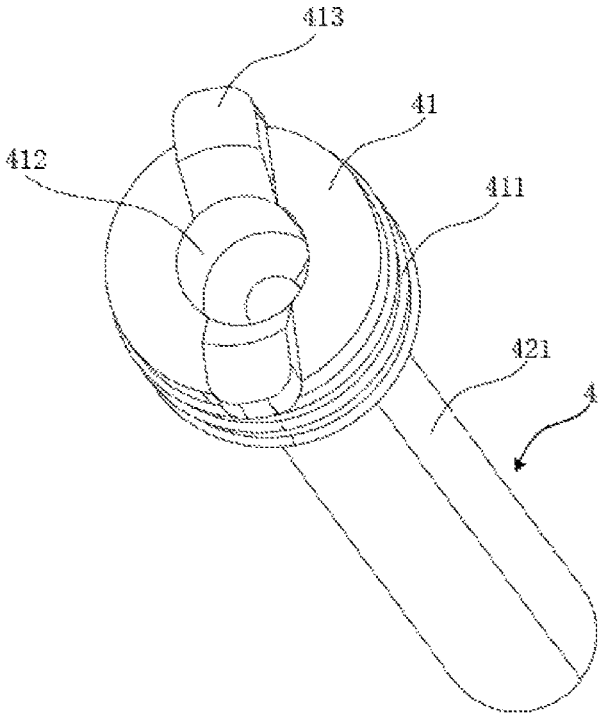
FIG. 7 is another schematic three-dimensional structural diagram of the plugging assembly provided in the embodiment of the present disclosure.

Please refer to FIG. 6 and FIG. 7 together, in some embodiments, the outer peripheral surface of the sealing member 41 is provided with a plurality of annular resisting protrusions 411 for elastically resisting the inner wall of the air inlet passage 31. By elastically resisting the inner wall of the air inlet passage 31 using the annular resisting protrusion 411; on the one hand, the annular resisting protrusion 411 can play a sealing function similar to a sealing ring to achieve a good sealing effect to the air inlet passage 31; on the other hand, the contact area between the outer wall of the sealing member 41 and the inner wall of the air inlet passage 31 is reduced, so as to reduce friction, which facilitates the smooth pulling of the sealing member 41 by the pulling member 42 to quickly remove away from the air inlet passage 31. It can be understood that the number of the annular resisting protrusions 411 on the outer peripheral surface of the sealing member 41 can be set to one, two, or more than three. When the number of the annular resisting protrusions 411 on the outer peripheral surface of the sealing member 41 is set to more than three, the distance between two adjacent annular resisting protrusions 411 can be made equal, which not only enhances the sealing performance, but also enhances the stability of the sealing member 41 when sliding along the inner wall of the air inlet passage 31 to avoid jamming of the sealing member 41.

Figure 12:
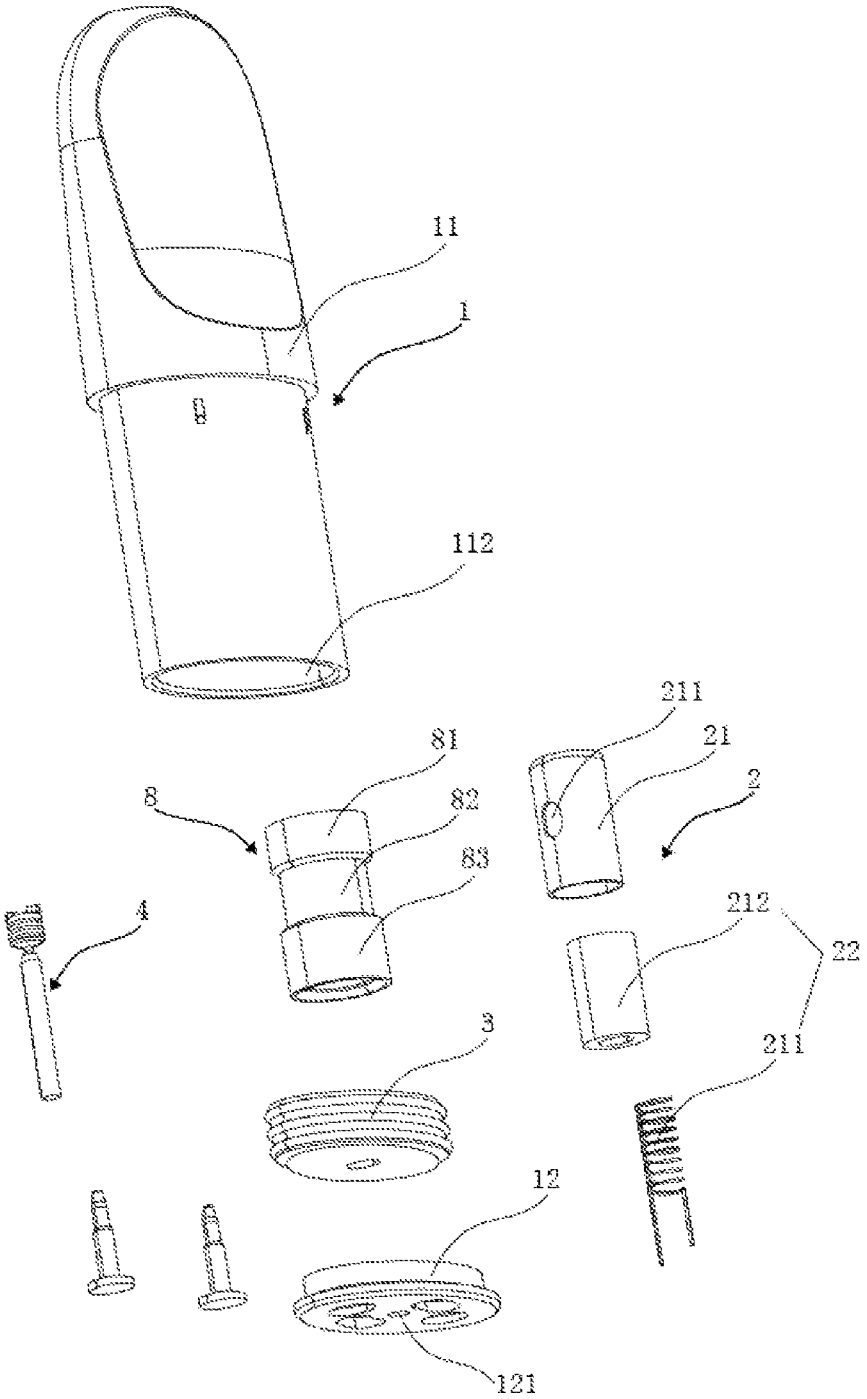
FIG. 12 is an exploded view of the atomizer provided in the embodiment of the present disclosure.

Please refer to FIG. 3 and FIG. 12 together, in some embodiments, the liquid storage member 1 includes a main housing 11 having an accommodating cavity and a bottom seat 12 sealed and installed at a bottom opening 112 of the main housing 11. The smoke outlet 111 is formed at the top end of the main housing 11. The sealing seat 3 is supported on one side of the bottom seat 12 facing the accommodating cavity. The atomizing assembly 2 includes an atomizing cover 21 with an open end supported on the sealing seat 3 and an atomizing core 22 for generating heat to heat the aerosol-forming substrate when energized. The inner cavity of the atomizing cover 21 forms the atomizing cavity 6, and the atomizing core 22 is disposed in the atomizing cavity 6. A vent tube 13 that communicates the atomizing cavity 6 with the smoke outlet 111 is provided in the main housing 11. A closed end of the atomizing cover 21 is provided with a smoke guiding hole 212. The inner cavity of the vent tube 13 forms a smoke guiding passage 14 that communicates the smoke guiding hole 212 with the smoke outlet 111. Specifically, the vent tube 13 and the atomizing cover 21 are detachably connected through a sealing sleeve 8 made of silicone material to facilitate the overall disassembly, assembly and replacement of the atomizing assembly 2. The portion of the interior of the main housing 11 other than the atomizing cover 21, the sealing seat 3 and the vent tube 13 defines the liquid storage cavity 5. It can be understood that, please refer to FIG. 8 and FIG. 9 together, in some embodiments, in order to ensure the amount of air intake, the liquid inlet hole 211 is provided on the side wall of the atomizing cover 21, and the air inlet hole 121 is provided on the bottom seat 12, wherein one or more than two air inlet holes 121 can be provided. By adopting the above solution, when the atomizer is in use, the aerosol-forming substrate in the liquid storage cavity 5 of the liquid storage member 1 enters the atomizing cavity 6 through the liquid inlet hole 211, and the atomizing core 22 is electrically driven by the power supply device 7 to heat and atomize the aerosol-forming substrate that enters the atomizing cavity 6. After the external air enters the atomizing cavity 6 from the air inlet hole 121 of the bottom seat 12 and the air inlet passage 31 of the sealing seat 3, it can quickly mix with the atomized aerosol-forming substrate to form smoke. The smoke is then guided to the smoke outlet 111 by the vent tube 13 along with the negative pressure airflow generated when the user sucks, for the user to inhale. Moreover, the liquid storage member 1 includes a main housing 11 with an accommodating cavity inside and a bottom opening 112 at the bottom, and a bottom seat 12 sealed and installed at the bottom opening 112 of the main housing 11, so that the atomizing assembly 2 can be conveniently installed in the main housing 11. It can be understood that the atomizing core 22 may include, but is not limited to, a heating wire 221 that can be energized to generate heat and a liquid guiding member 222 wrapped around the periphery of the heating wire 221 to evenly guide the aerosol-forming substrate to the heating wire 221. The liquid guiding member 222 can be, but is not limited to, a liquid-conducting cotton. The sealing seat 3 can be, but is not limited to, a sealing member made of silicone with heat insulation, sealing, and insulation properties. It is understood that in other embodiments, the air inlet hole 121 can also be provided on the main housing 11, and it is only required that the air inlet passage 31 is communicated with the air inlet hole 121. Of course, in other embodiments, the air inlet hole 121 is provided not only on the main housing 11, but also on the bottom seat 12, and it is only required that the air inlet hole 121 of the main housing 11 and the air inlet hole 121 of the bottom seat 12 are each communicated with the air inlet passage 31, or the air inlet hole 121 of the main housing 11 is communicated with the air inlet passage 31 through the air inlet hole 121 of the bottom seat 12.

Please refer to FIG. 3 and FIG. 12 together, in some embodiments, the outer contour of the atomizing cover 21 is in a tubular shape. The axial direction of the air inlet passage 31 is parallel to the axial direction of the atomizing cover 21. The plugging assembly 4 includes a sealing member 41 slidably disposed in the air inlet passage 31 and a pulling member 42 configured for pulling the sealing member 41 along the axial direction of the atomizing cover 21 to remove the sealing member 41 away from the air inlet passage 31. One end of the pulling member 42 is connected to the sealing member 41, and the bottom seat 12 is correspondingly provided with an opening 122 for the other end of the pulling member 42 to pass through. The other end of the pulling member 42 passes through the opening 122 to extend to the outside of the liquid storage member 1. A first port 311 of the air inlet passage 31 is communicated with the atomizing cavity 6. A first groove 123 for accommodating the sealing member 41 is provided on one side of the bottom seat 12 facing the sealing seat 3. The first groove 123 communicates the air inlet hole 121 with a second port 312 of the air inlet passage 31. By adopting the above solution, the first groove 123 is provided on the side of the bottom seat 12 facing the sealing seat 3, the sealing member 41 can be directly accommodated in the first groove 123 after being removed away from the air inlet passage 31 under the pulling action of the pulling member 42, and at this time, the air inlet hole 121 is communicated with the air inlet passage 31 through the first groove 123. At the same time, after the sealing member 41 is removed away from the air inlet passage 31, the aerosol-forming substrate leaking from the air inlet passage 31 can be stored in the first groove 123, to ensure that liquid will not leak from the air inlet hole 121 during use of the atomizer, thereby improving the user experience.

Figure 5:
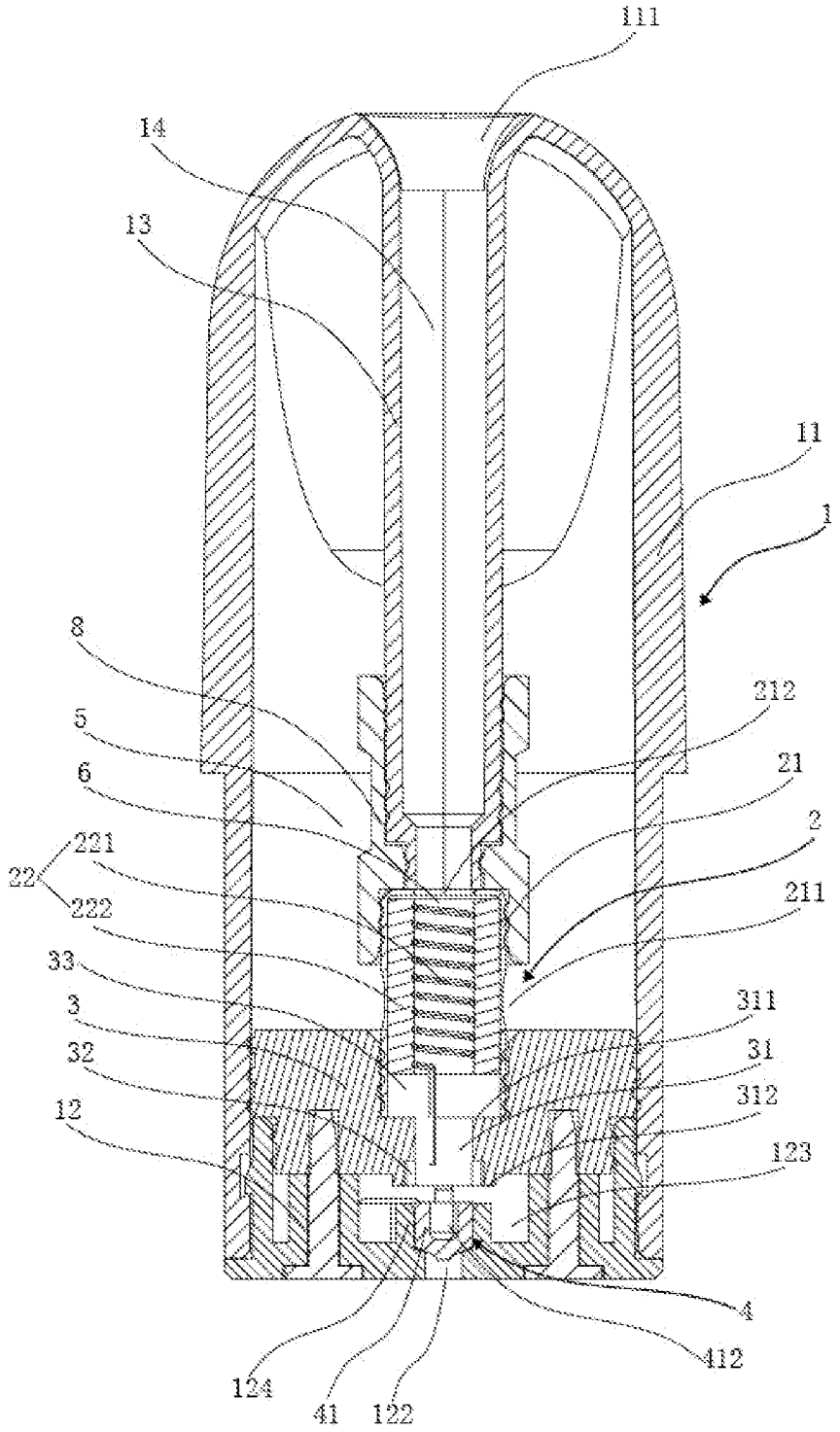
FIG. 5 is another schematic cross-sectional structural diagram of the atomizer provided in the embodiment of the present disclosure.
Figure 11:
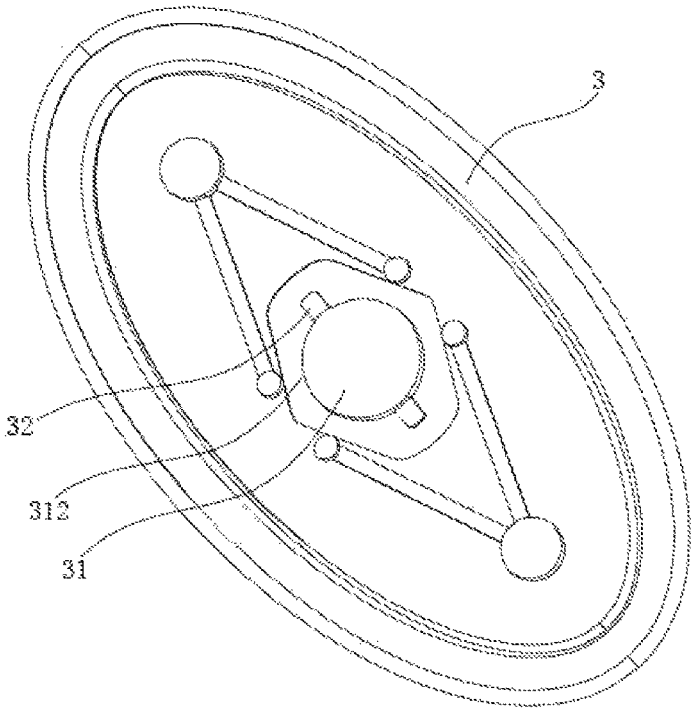
FIG. 11 is another schematic three-dimensional structural diagram of the sealing seat provided in the embodiment of the present disclosure.

Please refer to FIG. 5 and FIG. 11 together, in some embodiments, a vent groove 32 is provided on the sealing seat 3 adjacent to the second port 312 of the air inlet passage 31, so that when the pulling member 42 is about to pull the sealing member 41 out of the air inlet passage 31, the vent groove 32 can communicate the atomizing cavity 6 with the first groove 123 and/or the air inlet hole 121, allowing external air to enter the atomizing cavity 6 through the vent groove 32 to prevent the aerosol-forming substrate in the liquid storage cavity 5 from being sucked out to cause a large amount of liquid leakage due to negative pressure generated in the atomizing cavity 6 during the process when the pulling member 42 pulls the sealing member 41 out of the air inlet passage 31. It can be understood that one or more than two vent grooves 32 can be provided, and the specific number of the vent grooves 32 can be reasonably selected according to actual use needs, and is not uniquely limited here.

Figure 4:
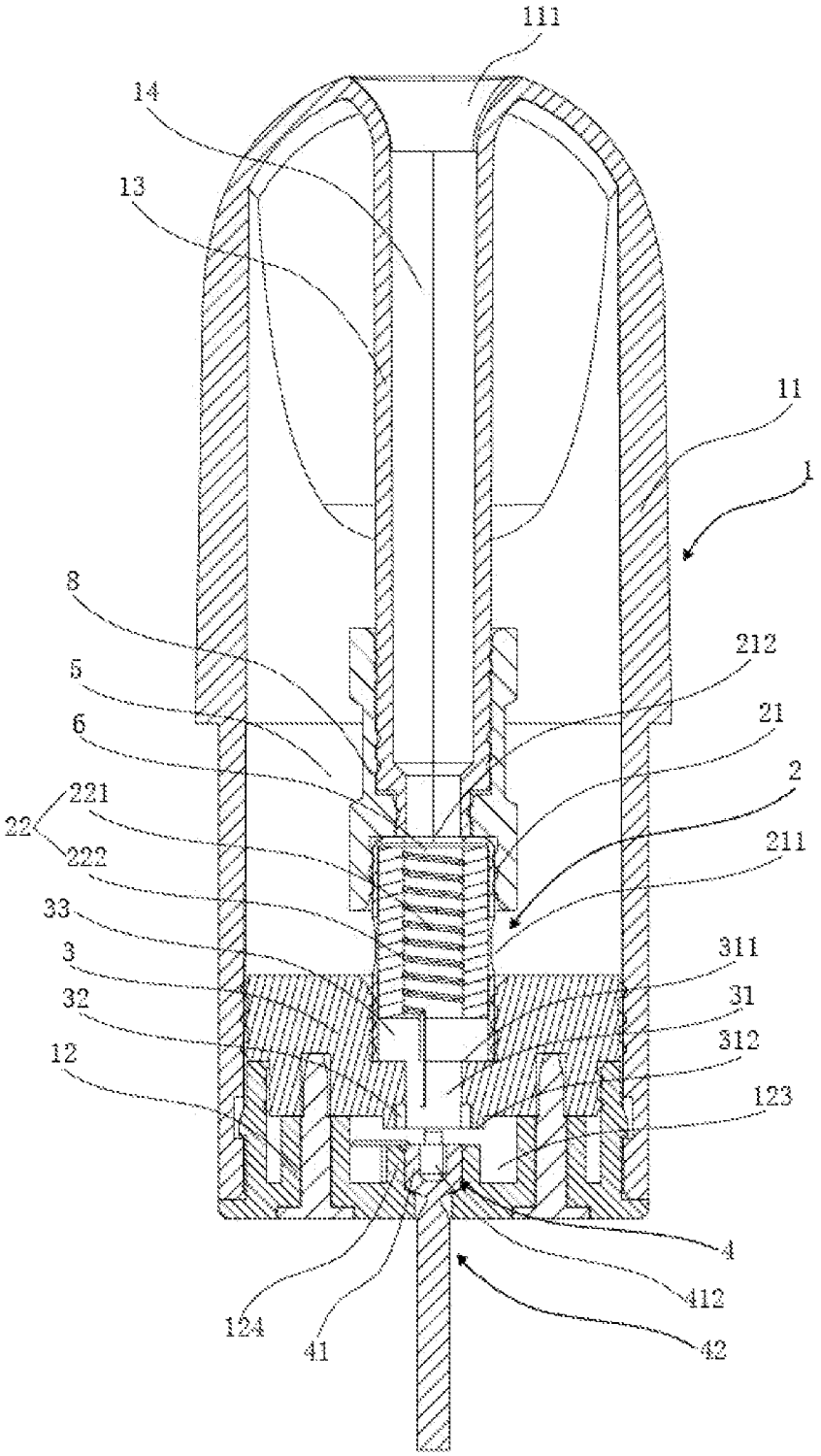
FIG. 4 is another schematic cross-sectional structural diagram of the atomizer provided in the embodiment of the present disclosure.
Figure 8:
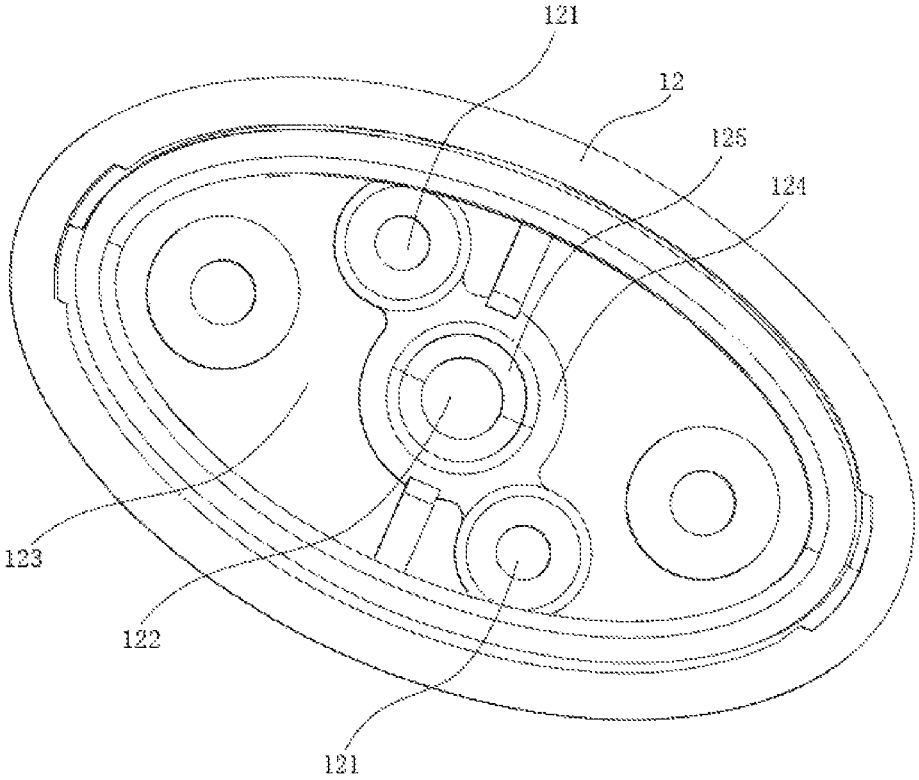
FIG. 8 is a schematic three-dimensional structural diagram of a bottom seat provided in the embodiment of the present disclosure.

Please refer to FIG. 4 and FIG. 8 together, in some embodiments, a protrusion 124 is provided on the bottom seat 12 corresponding to the position of the air inlet passage 31. The protrusion 124 is located in the first groove 123, so that the portion of the first groove 123 other than the protrusion 124 forms a liquid reservoir. In this way, after the sealing member 41 is removed away from the air inlet passage 31, the aerosol-forming substrate leaking from the air inlet passage 31 can be stored in the liquid reservoir, to ensure that liquid will not leak from the air inlet hole 121 during use of the atomizer, thereby improving the user experience. Moreover, a liquid-absorbing cotton is provided in the liquid reservoir, so that the liquid collected in the liquid reservoir is absorbed and stored by the liquid-absorbing cotton, which further helps to ensure that liquid will not leak from the air inlet hole 121 during use of the atomizer, thereby improving the user experience. The opening 122 is provided on the protrusion 124, and the axial direction of the opening 122 is parallel to the axial direction of the atomizing cover 21. The protrusion 124 is further recessed to form a positioning groove 125 for accommodating and positioning the sealing member 41, and the positioning groove 125 is communicated with the opening 122. By adopting the above solution, the positioning groove 125 is provided on the protrusion 124 located in the first groove 123, and the sealing member 41 can be directly positioned in the positioning groove 125 after being removed away from the air inlet passage 31 under the pulling action of the pulling member 42, thereby facilitating the rapid pulling apart the long rod section 421 from the sealing member 41.

Please refer to FIG. 3 and FIG. 7 together, in some embodiments, one side of the sealing member 41 facing the atomizing cover 21 is recessed to form a second groove 412, so as to use the second groove 412 to store the liquid leaking through the air inlet passage 31, which is beneficial to preventing the leaked liquid from flowing to the air inlet hole 121, thereby further improving the effect of preventing liquid leakage. Moreover, after the sealing member 41 is removed away from the air inlet passage 31, the height of the top open end of the air inlet hole 121 is higher than the height of the top open end of the second groove 412 in the direction from the bottom seat 12 to the smoke outlet 111, so that when the user uses the atomizer to inhale the smoke, the leakage from the air inlet passage 31 will not flow to the air inlet hole 121, which is conducive to blowing away the surrounding condensate by the airflow entering through the air inlet hole 121, further improving the effect of preventing liquid leakage.

Please refer to FIG. 6 and FIG. 7 together, in some embodiments, the sealing member 41 is provided with a stopping projection 413 for restricting the movement of the sealing member 41. By adopting the above solution, the stopping projection 413 is projected on the sealing member 41, when the sealing member 41 is used to seal the air inlet passage 31, the stopping projection 413 abuts against the first port 311 of the air inlet passage 31 to remind that the sealing member 41 is assembled in place. After the sealing member 41 is pulled away from the air inlet passage 31 by the pulling member 42, the bottom of the sealing member 41 is directly positioned in the positioning groove 125, and the stopping projection 413 abuts against the second port 312 of the air inlet passage 31, so that the sealing member 41 is fixed in the positioning groove 125, thereby effectively preventing the sealing member 41 from loosening and shifting.

Figure 10:
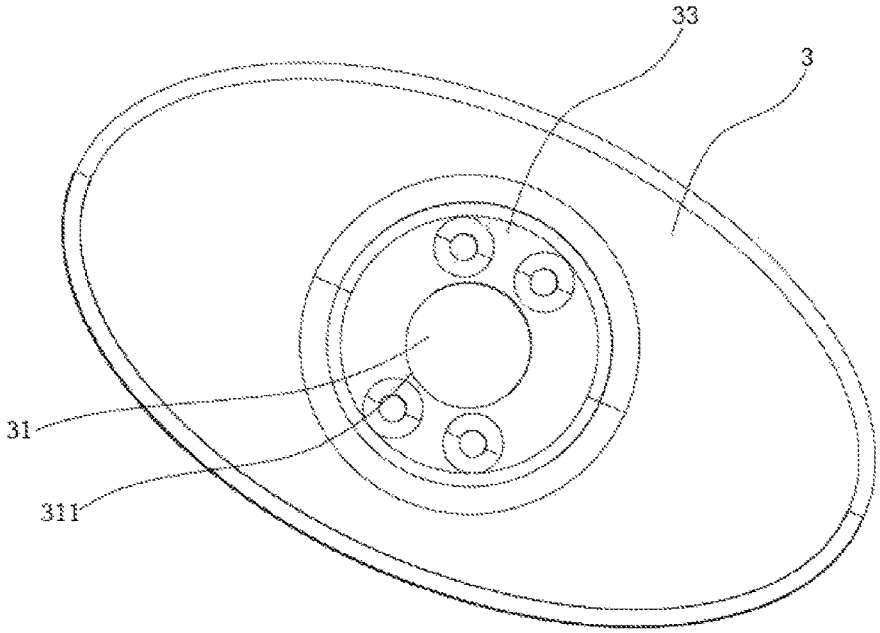
FIG. 10 is a schematic three-dimensional structural diagram of a sealing seat provided in the embodiment of the present disclosure.

Please refer to FIG. 5 and FIG. 10 together, in some embodiments, the sealing seat 3 is provided with a positioning hole 33 for accommodating and positioning the open end of the atomizing cover 21. The first port 311 of the air inlet passage 31 is communicated with the open end of the atomizing cover 21, and the diameter of the positioning hole 33 is larger than the diameter of the air inlet passage 31 to form a stepped hole on the sealing member 41. By adopting the above solution, the sealing seat 3 is provided with the positioning hole 33, it is only required to accommodate and position the open end of the atomizing cover 21 into the positioning hole 33, to enhance the stability and sealing effect of the installation of the atomizing cover 21. Also, the first port 311 of the air inlet passage 31 is communicated with the opening end of the atomizing cover 21, and the diameter of the positioning hole 33 is larger than the diameter of the air inlet passage 31 to form a stepped hole on the sealing member 41, and the first port 311 of the air inlet passage 31 is directly used to abut against the open end of the atomizing cover 21, so that the air inlet passage 31 can communicate the atomizing cavity 6 with the air inlet hole 121 properly.

Please refer to FIG. 1 to FIG. 5 and FIG. 12 to FIG. 17 together, an atomizer provided in another embodiment of the present disclosure is described. The atomizer provided in another embodiment of the present disclosure includes a liquid storage member 1, an atomizing assembly 2, and a sealing sleeve 8. The liquid storage member 1 includes a main housing 11 having an accommodating cavity therein, a bottom seat 12 detachably installed at a bottom opening 112 of the main housing 11, and a vent tube 13 at least partially received in the accommodating cavity. The top end of the main housing 11 is provided with a smoke outlet 111, and the top end of the vent tube 13 extends to the smoke outlet 111 and is communicated with the smoke outlet 111. The bottom end of the vent tube 13 extends into the accommodating cavity. The atomizing assembly 2 is configured to atomize the aerosol-forming substrate to form smoke that can be inhaled by the user. The atomizing assembly 2 is supported and fixed on the bottom seat 12, and the atomizing assembly 2 is accommodated in the accommodating cavity. An atomizing cavity 6 that is separated from the accommodating cavity is provided inside the atomizing assembly 2. Please refer to FIG. 13 and FIG. 14 together, the sealing sleeve 8 is slidably sleeved on the bottom end of the vent tube 13, and under the action of an external force, the sealing sleeve 8 can slide from a first preset position to a second preset position along the axial direction of the vent tube 13. It can be understood that the first preset position is the position where the sealing sleeve 8 is installed on the vent tube 13 when liquid is injected into the liquid storage cavity 5 through the bottom opening 112 of the main housing 11. The second preset position is the position where the sealing sleeve 8 is installed on the vent tube 13 when the atomizing assembly 2 is installed in the accommodating cavity. The top end of the main housing 11 refers to the part of the main housing 11 having the smoke outlet 111 or having a mouthpiece installed at the smoke outlet 111. The bottom end of the main housing 11 refers to the part of the main housing 11 having the bottom seat 12 being installed. The top end of the vent tube 13 refers to the end of the vent tube 13 close to the smoke outlet 111. The bottom end of the vent tube 13 refers to the end of the vent tube 13 close to the bottom seat 12. The first preset position and the second preset position are sequentially set along the direction from the bottom seat 12 to the smoke outlet 111. When installing the atomizing assembly 2 into the accommodating cavity and installing the bottom seat 12 to the bottom opening 112 of the main housing 11, the atomizing assembly 2 can push the sealing sleeve 8 from the first preset position to the second preset position, and the atomizing cavity 6 is communicated with the bottom end of the vent tube 13. The portion of the interior of the main housing 11 other than the atomizing assembly 2, the sealing sleeve 8 and the vent tube 13 defines a liquid storage cavity 5 for storing the aerosol-forming substrate. The atomizing assembly 2 is provided with a liquid inlet hole 211 that communicates the liquid storage cavity 5 with the atomizing cavity 6. The aerosol-forming substrate in the liquid storage cavity 5 can flow into the atomizing cavity 6 through the liquid inlet hole 211, and the aerosol-forming substrate entering the atomizing cavity 6 can be heated and atomized by the atomizing core 22 in the atomizing cavity 6 to form smoke.

Please also refer to FIG. 15, when injecting liquid (at this time, the atomizing assembly 2 is not installed into the accommodating cavity and the bottom seat 12 is not installed to the bottom opening 112 of the main housing 11), it is only required to place the main housing 11 in an inverted state with the smoke outlet 111 located below and the bottom opening 112 facing upward, the sealing sleeve 8 is sleeved on the bottom end of the vent tube 13 to cause the sealing sleeve 8 to be located in the first preset position, and the aerosol-forming substrate is filled into the accommodating cavity through the bottom opening 112 of the main housing 11 until the liquid injection level 10 is slightly lower than the end face of the end of the sealing sleeve 8 away from the smoke outlet 111, or the liquid injection level is flush with the end face of the end of the sealing sleeve 8 away from the smoke outlet 111. Thereafter, the atomizing assembly 2 is installed into the accommodating cavity of the main housing 11. Please refer to FIG. 16, after the atomizing assembly 2 is inserted into the sealing sleeve 8, the sealing sleeve 8 is pushed from the first preset position to the second preset position by the atomizing assembly 2, the sealing sleeve 8 moves toward the smoke outlet 111 along with the atomizing assembly 2 until the atomizing cavity 6 of the atomizing assembly 2 is communicated with the bottom end of the vent tube 13, and the bottom seat 12 is sealed and installed at the bottom opening 112 of the main housing 11, so that the portion of the interior of the main housing 11 other than the atomizing assembly 2, the sealing sleeve 8 and the vent tube 13 defines a liquid storage cavity 5 for storing the aerosol-forming substrate. In this way, the liquid storage cavity 5 of the liquid storage member 1 is filled with the aerosol-forming substrate 9, thereby increasing the amount of liquid injected into the liquid storage space inside the atomizer, effectively reducing the waste of the liquid storage space inside the atomizer, and solving the problem that liquid is difficult to be fully filled into the liquid storage space inside the atomizer of disposable aerosol generating device. To a certain extent, the generation of bubbles in the atomizer during transportation or storage can be reduced or avoided.

Compared with the prior art, in the atomizer provided in the embodiment of the present disclosure, the vent tube 13 and the sealing sleeve 8 are disposed inside the main housing 11, the top end of the vent tube 13 is extended to the smoke outlet 111 at the top end of the main housing 11, the bottom end of the vent tube 13 is extended to the accommodating cavity of the main housing 11, and one end of the sealing sleeve 8 is slidably sleeved on the bottom end of the vent tube 13. Then when injecting liquid, it is only needed to place the main housing 11 upside down, the sealing sleeve 8 is installed in the first preset position, and then, the aerosol-forming substrate can be added into the accommodating cavity through the bottom opening 112 of the main housing 11. Until the injection liquid level is slightly lower than or flush with the end face of the other end of the sealing sleeve 8, the atomizing assembly 2 is inserted into the other end of the sealing sleeve 8, the sealing sleeve 8 is pushed toward the smoke outlet 111 through the atomizing assembly 2, the sealing sleeve 8 moves from the first preset position to the second preset position, the atomizing cavity 6 of the atomizing assembly 2 is communicated with the bottom end of the vent tube 13, and the bottom seat 12 is sealed and installed at the bottom opening 112 of the main housing 11, so that the portion of the interior of the main housing 11 other than the atomizing assembly 2, the sealing sleeve 8 and the vent tube 13 can define a liquid storage cavity 5 for storing the aerosol-forming substrate. In this way, the amount of liquid injected into the liquid storage space inside the atomizer can be increased, thereby effectively reducing the waste of the liquid storage space inside the atomizer, and to a certain extent, the generation of bubbles in the atomizer during transportation or storage can be reduced or avoided.

Figure 13:
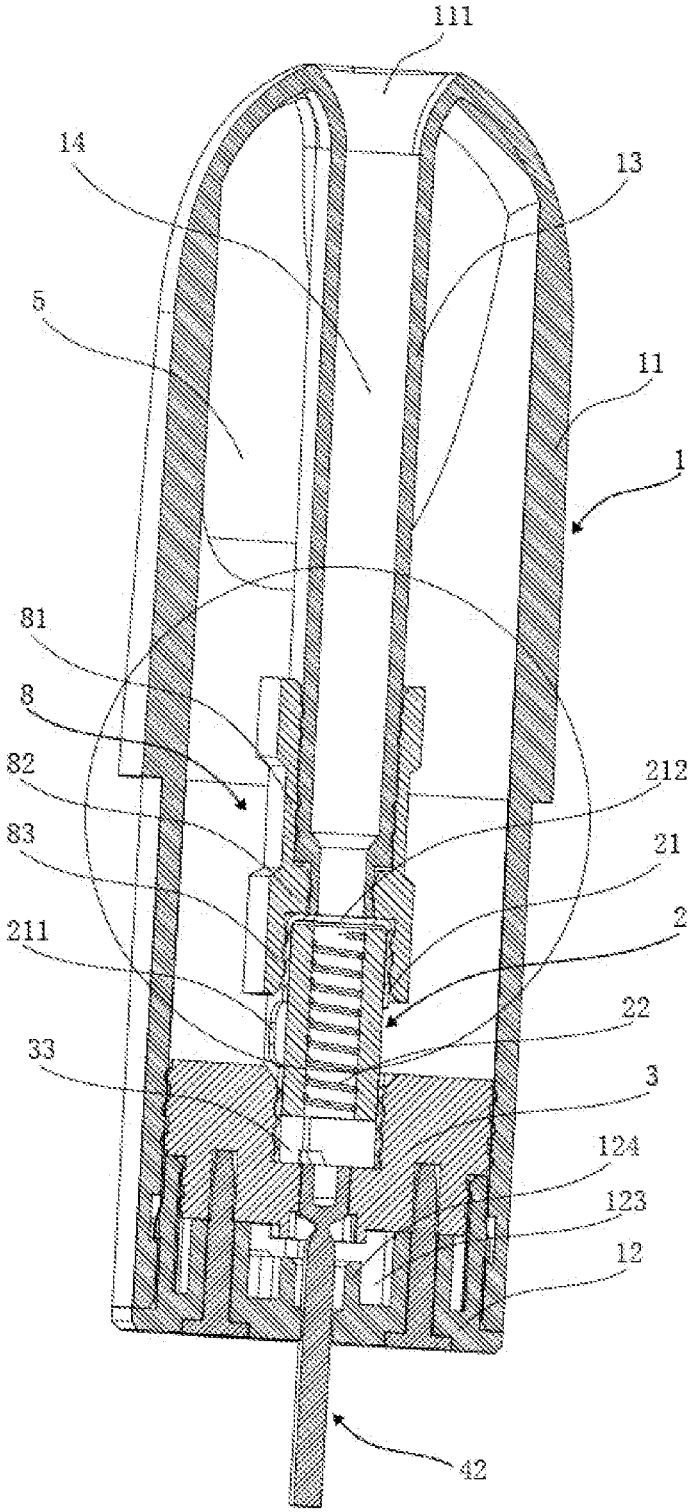
FIG. 13 is a schematic cross-sectional structural diagram of an atomizer provided in an embodiment of the present disclosure.
Figure 14:
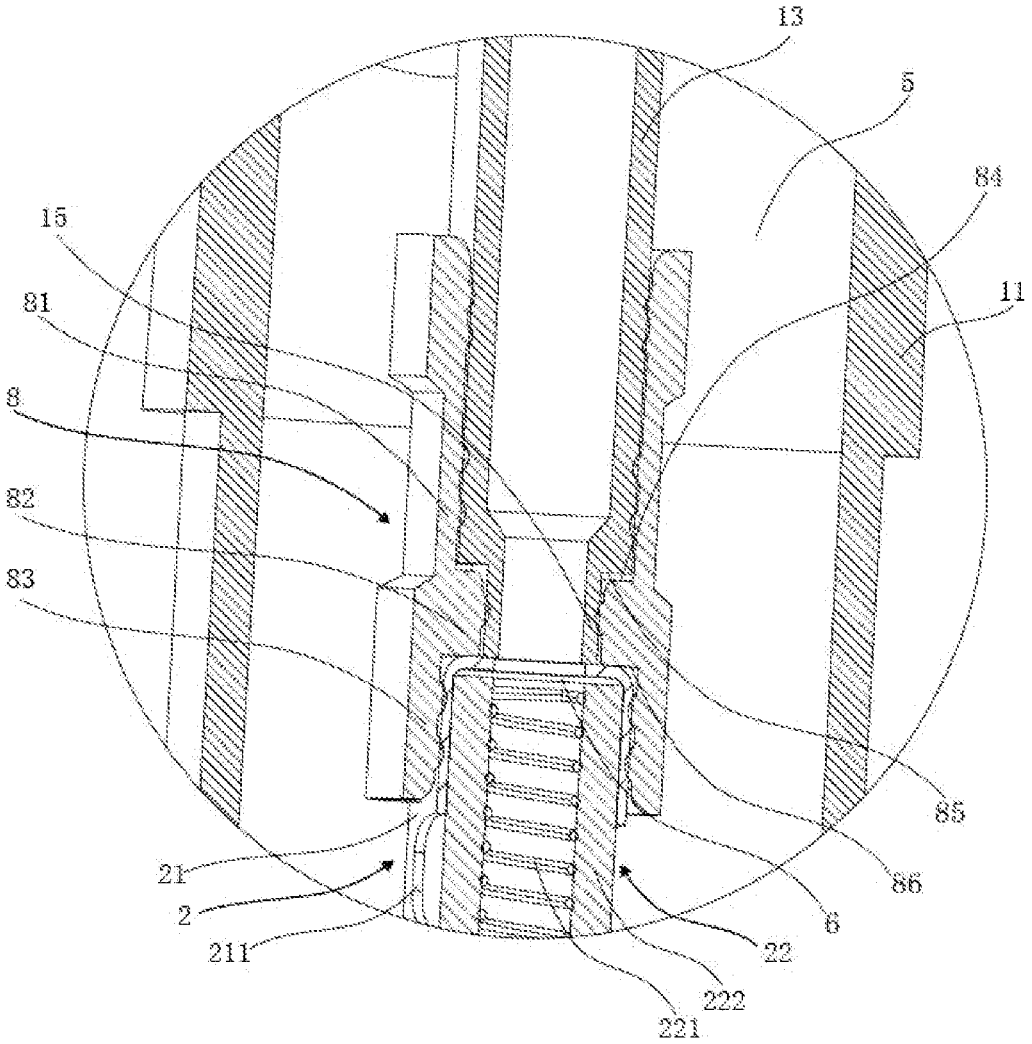
FIG. 14 is a partially enlarged structural diagram of FIG. 13.
Figure 17:
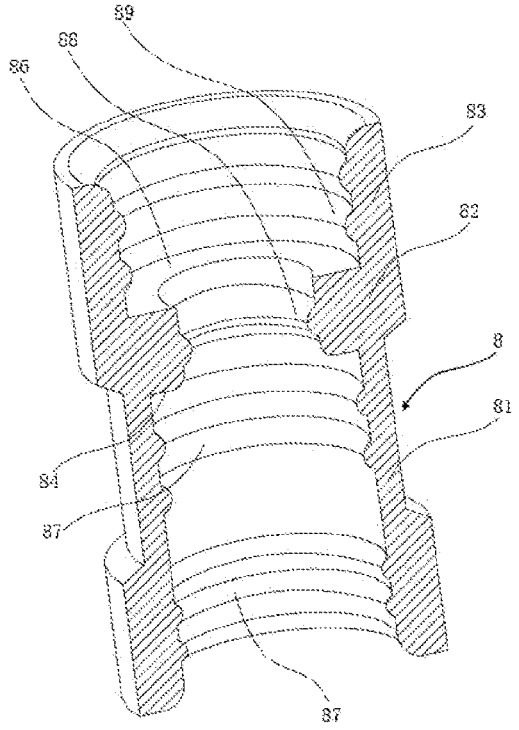
FIG. 17 is a schematic cross-sectional structural diagram of a sealing sleeve provided in the embodiment of the present disclosure.

Please refer to FIG. 13, FIG. 14 and FIG. 17 together, in some embodiments, the sealing sleeve 8 includes a first sleeve section 81 for being slidably sleeved on the vent tube 13, an annular sleeve section 82 for being resisted by the end of the atomizing assembly 2, and a second sleeve section 83 for being sleeved on the end of the atomizing assembly 2. The annular sleeve section 82 connects the first sleeve section 81 and the second sleeve section 83 to form the sealing sleeve 8. The first sleeve section 81 is connected to the annular sleeve section 82, and the inner diameter of the first sleeve section 81 is larger than the diameter of an annular hole of the annular sleeve section 82, so as to form a first step surface 84 at the connection position between the first sleeve section 81 and the annular sleeve section 82. In this embodiment, by adopting the above solution, the sealing sleeve 8 is a silicone member made of silicone material, and it is only required that the first sleeve section 81 is sleeved on the bottom end of the vent tube 13 and the second sleeve section 83 is sleeved on the end of the atomizing assembly 2, the sealing sleeve 8 will be hermetically connected to each of the vent tube 13 and the atomizing assembly 2, thereby preventing leakage of the aerosol-forming substrate. Moreover, the first sleeve section 81 and the second sleeve section 83 are connected through the annular sleeve section 82 to form the entire sealing sleeve 8, and by the end of the atomizing assembly 2 abutting against the annular sleeve section 82, the sealing sleeve 8 is driven to move from the first preset position to the second preset position, thereby enhancing the stability and reliability of the movement of the atomizing assembly 2 against the sealing sleeve 8. In addition, the connection position between the first sleeve section 81 and the annular sleeve section 82 forms a first step surface 84, and when the sealing sleeve 8 moves to the second preset position, the bottom end face of the vent tube 13 abuts against the first step surface 84 to limit the sealing sleeve 8 in the second preset position and provide a reminding function that the atomizing assembly 2 and the sealing sleeve 8 are installed in place.

Please refer to FIG. 17, in some embodiments, a first annular protrusion 87 is provided on the inner wall of the first sleeve section 81 along the circumferential direction of the first sleeve section 81. In this embodiment, by adopting the above solution, the first annular protrusion 87 on the inner wall of the first sleeve section 81 elastically abuts against the outer wall of the vent tube 13; on the one hand, the first annular protrusion 87 can play a sealing function similar to a sealing ring, thereby enhancing the sealing performance of the sliding connection between the first sleeve section 81 and the vent tube 13, and preventing the aerosol-forming substrate from leakage; on the other hand, the contact area between the inner wall of the first sleeve section 81 and the outer wall of the vent tube 13 is reduced, so as to reduce friction. It can be understood that more than two first annular protrusions 87 can be provided, and the more than two first annular protrusions 87 are spaced from each other to further enhance the sealing performance and prevent liquid leakage. Moreover, when more than two first annular protrusions 87 are provided, the more than two first annular protrusions 87 are distributed at the upper and lower sides of the inner wall of the first sleeve section 81, and when the sealing sleeve 8 moves to the second preset position, the first annular protrusions 87 distributed at the upper and lower sides of the first sleeve section 81 have the function of installation and positioning.

Figure 15:
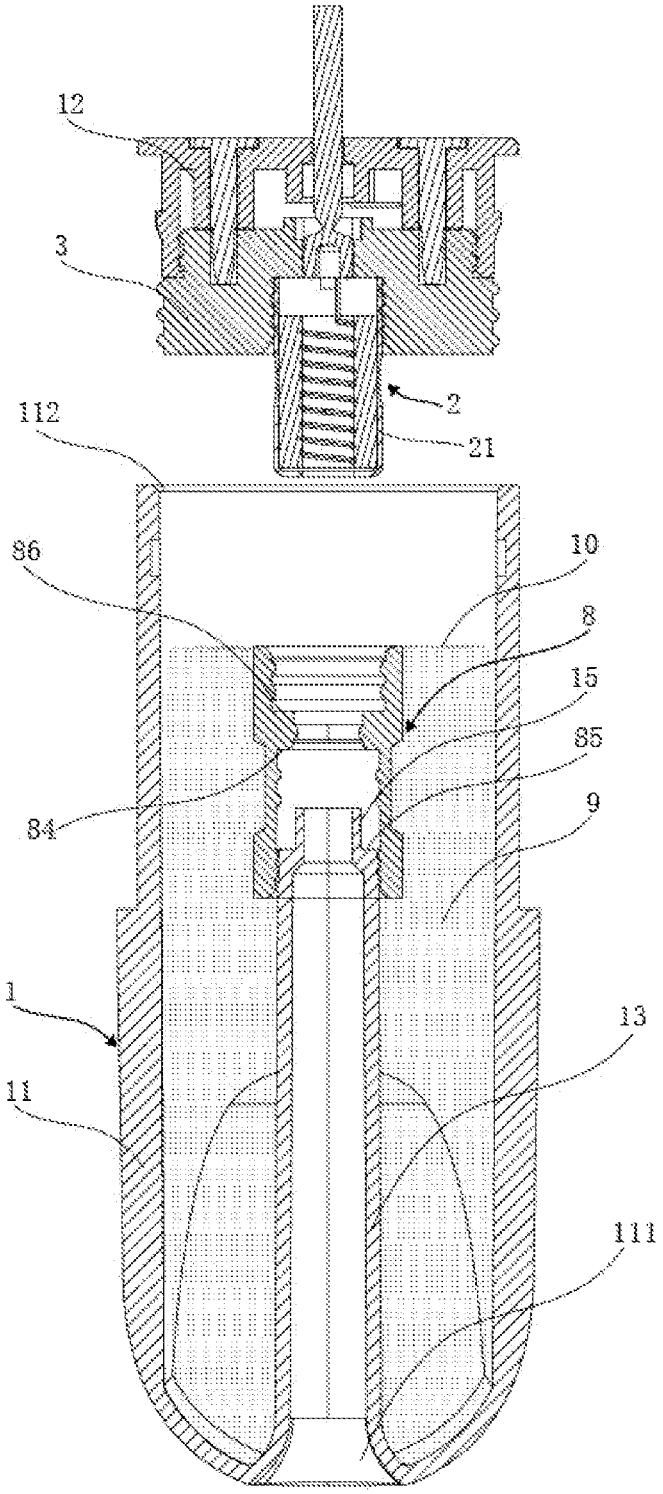
FIG. 15 is a schematic cross-sectional structural diagram of the atomizer provided in the embodiment of the present disclosure when filling liquid.

Please refer to FIG. 14, FIG. 15 and FIG. 17 together, in some embodiments, the bottom end face of the vent tube 13 is provided with a connecting tube 15 for connecting the atomizing cavity 6 and the vent tube 13. The connecting tube 15 extends from the bottom end of the vent tube 13 toward the bottom seat 12. The outer diameter of the connecting tube 15 is smaller than the outer diameter of the vent tube 13 to form a second step surface 85 at the connection position between the vent tube 13 and the connecting tube 15. The second step surface 85 is configured to abut against the first step surface 84. In this embodiment, by adopting the above solution, when the sealing sleeve 8 moves to the second preset position, the second step surface 85 formed at the connection position between the vent tube 13 and the connecting tube 15 abuts against the first step surface 84, so as to limit the sealing sleeve 8 in the second preset position and provide a reminding function that the atomizing assembly 2 and the sealing sleeve 8 are installed in place. Please refer to FIG. 13 and FIG. 14 together, in some embodiments, when the sealing sleeve 8 is installed in the second preset position, the annular sleeve section 82 is sleeved on the connecting tube 15 to provide the function of positioning the sealing sleeve 8, thereby enhancing the stability of the sealing sleeve 8 when installed in the second preset position.

Please also refer to FIG. 17, in some embodiments, a second annular protrusion 88 is provided on the inner wall of the annular hole of the annular sleeve section 82 along the circumferential direction of the annular sleeve section 82. In this embodiment, by adopting the above solution, the second annular protrusion 88 on the inner wall of the annular hole of the annular sleeve section 82 elastically abuts against the outer wall of the connecting tube 15; on the one hand, the second annular protrusion 88 can play a sealing function similar to a sealing ring, thereby enhancing the sealing performance of the sliding connection between the annular sleeve section 82 and the connecting tube 15, and preventing the aerosol-forming substrate from leakage; on the other hand, the contact area between the inner wall of the annular sleeve section 82 and the outer wall of the connecting tube 15 is reduced, so as to reduce friction. It can be understood that more than two second annular protrusions 88 can be provided, and the more than two second annular protrusions 88 are spaced from each other to further enhance the sealing performance and prevent liquid leakage.

Please refer to FIG. 5, FIG. 13 and FIG. 14 together, in some embodiments, the atomizing assembly 2 includes an atomizing cover 21 with an open end supported on the bottom seat 12 and an atomizing core 22 for generating heat to heat the aerosol-forming substrate when energized. The inner cavity of the atomizing cover 21 forms the atomizing cavity 6, and the atomizing core 22 is disposed in the atomizing cavity 6. A closed end of the atomizing cover 21 is provided with a smoke guiding hole 212. The bottom end of the vent tube 13 is communicated with the smoke guiding hole 212. The portion of the interior of the main housing 11 other than the atomizing cover 21, the sealing sleeve 8 and the vent tube 13 defines a liquid storage cavity 5. The liquid inlet hole 211 is provided on the side wall of the atomizing cover 21. When the atomizer is in use, the aerosol-forming substrate in the liquid storage cavity 5 of the liquid storage member 1 enters the atomizing cavity 6 through the liquid inlet hole 211, and the atomizing core 22 is electrically driven by the power supply device 7 to heat and atomize the aerosol-forming substrate that enters the atomizing cavity 6. After the external air enters the atomizing cavity 6 from the air inlet hole 121 of the bottom seat 12 and the air inlet passage 31 of the sealing seat 3, it can quickly mix with the atomized aerosol-forming substrate to form smoke. The smoke is then guided to the smoke outlet 111 by the vent tube 13 along with the negative pressure airflow generated when the user sucks, for the user to inhale. It can be understood that the atomizing core 22 may include, but is not limited to, a heating wire 221 that can be energized to generate heat and a liquid guiding member 222 wrapped around the periphery of the heating wire 221 to evenly guide the aerosol-forming substrate to the heating wire 221. The liquid guiding member 222 can be, but is not limited to, a liquid-conducting cotton. It can be understood that when the atomizing assembly 2 includes an atomizing cover 21 with an open end supported on the bottom seat 12, the sealing sleeve 8 includes a first sleeve section 81 for being slidably sleeved on the vent tube 13, an annular sleeve section 82 for being resisted by the closed end of the atomizing cover 21, and a second sleeve section 83 for being sleeved on the closed end of the atomizing cover 21. The annular sleeve section 82 connects the first sleeve section 81 and the second sleeve section 83 to form the sealing sleeve 8.

Please refer to FIG. 14, FIG. 15 and FIG. 17 together, in some embodiments, the inner diameter of the second sleeve section 83 is larger than the diameter of the annular hole of the annular sleeve section 82, so as to form a third step surface 86 at the connection position between the second sleeve section 83 and the annular sleeve section 82. The third step surface 86 is configured to abut against the closed end of the atomizing cover 21. In this embodiment, by adopting the above solution, after inserting into the second sleeve section 83, the closed end of the atomizing cover 21 abuts against the third step surface 86 formed at the connection position between the second sleeve section 83 and the annular sleeve section 82, and the atomizing cover 21 pushes the sealing sleeve 8 to move from the first preset position to the second preset position, thereby enhancing the stability and reliability of the movement of the atomizing assembly 2 against the sealing sleeve 8.

Please refer to FIG. 17, in some embodiments, a third annular protrusion 89 is provided on the inner wall of the second sleeve section 83 along the circumferential direction of the second sleeve section 83. In this embodiment, by adopting the above solution, the third annular protrusion 89 on the inner wall of the second sleeve section 83 elastically abuts against the outer wall of the atomizing cover 21, so as to play a sealing function similar to a sealing ring, thereby enhancing the sealing performance of the connection between the second sleeve section 83 and the closed end of the atomizing cover 21, and preventing the aerosol-forming substrate from leakage. It can be understood that more than two third annular protrusions 89 can be provided, and the more than two third annular protrusions 89 are spaced from each other to further enhance the sealing performance and prevent liquid leakage.

Figure 16:
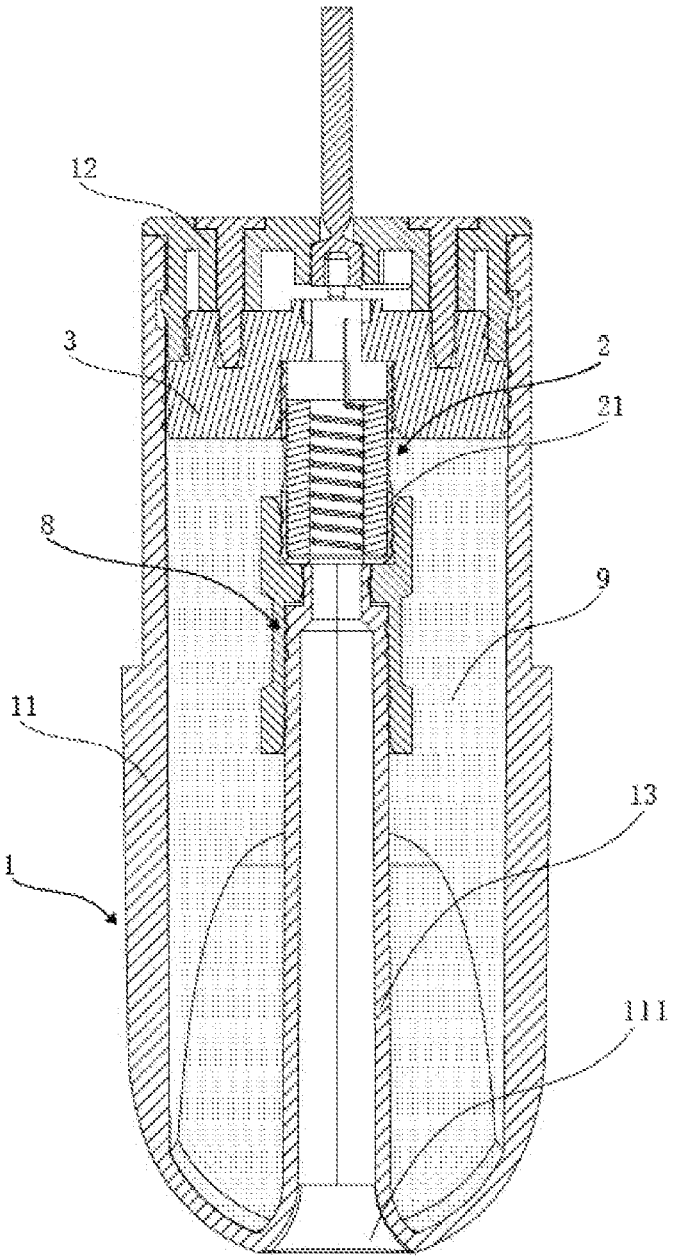
FIG. 16 is a schematic cross-sectional structural diagram of the atomizer provided in the embodiment of the present disclosure after liquid injection.

Please refer to FIG. 13, FIG. 15 and FIG. 16 together, in some embodiments, the atomizer further includes a sealing seat 3 supported on one side of the bottom seat 12 facing the accommodating cavity. The open end of the atomizing cover 21 of the atomizing assembly 2 is supported and fixed on the sealing seat 3 to form an atomizing cavity 6 in the inner cavity of the atomizing cover 21. The liquid inlet hole 211 is provided on the side wall of the atomizing cover 21. In this embodiment, by adopting the above solution, the atomizing cover 21 of the atomizing assembly 2 is supported and fixed on the bottom seat 12 through the sealing seat 3, thereby enhancing the sealing performance and preventing liquid leakage.

Figure 18:
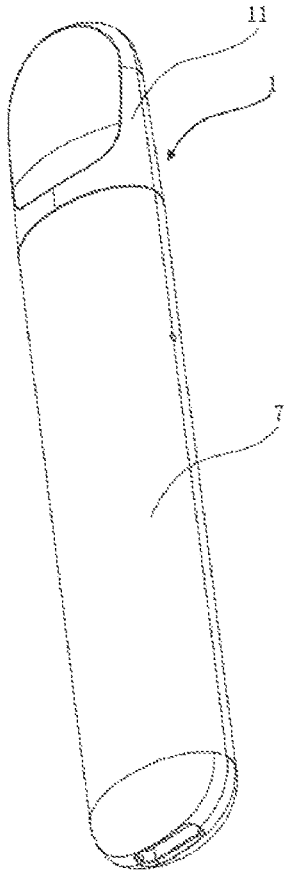
FIG. 18 is a schematic three-dimensional structural diagram of an aerosol generating device provided in an embodiment of the present disclosure.

Please also refer to FIG. 18, the embodiment of the present disclosure further provides an aerosol generating device. The aerosol generating device provided in the embodiment of the present disclosure includes an atomizer for atomizing an aerosol-forming substrate and a power supply device 7 for supplying power to the atomizer. The atomizer is the atomizer provided in any of the above embodiments, and the atomizer starts working under the electric drive of the power supply device 7 of the aerosol generating device. Since the aerosol generating device provided in the embodiment of the present disclosure has all the technical features of the atomizer provided in any of the above embodiments, it has the same technical effect as the above atomizer.

The above are only preferred embodiments of the present disclosure and are not intended to limit the present disclosure, any modifications, equivalent replacements and improvements made within the spirit and principles of the present disclosure shall be included in the protection scope of the present disclosure.

What is claimed is:

1. An atomizer for an aerosol generating device, comprising:

a liquid storage member having an accommodating cavity therein, wherein the liquid storage member is provided with a smoke outlet;

a sealing seat disposed in the accommodating cavity;

an atomizing assembly configured to atomize an aerosol-forming substrate to form smoke that can be inhaled by a user, wherein the atomizing assembly is disposed in the accommodating cavity, and the atomizing assembly is supported on the sealing seat, so that the portion of the interior of the liquid storage member other than the atomizing assembly and the sealing seat defines a liquid storage cavity for storing the aerosol-forming substrate, an atomizing cavity that is separated from the liquid storage cavity is provided inside the atomizing assembly, the atomizing assembly is provided with a liquid inlet hole that communicates the liquid storage cavity with the atomizing cavity, the atomizing cavity is communicated with the smoke outlet, the liquid storage member is further provided with an air inlet hole, the sealing seat is provided with an air inlet passage that communicates the atomizing cavity with the air inlet hole; and a plugging assembly configured to seal the air inlet passage before the aerosol generating device is put into use;

wherein the liquid storage member comprises a main housing having the accommodating cavity and a bottom seat installed at a bottom opening of the main housing, the smoke outlet is formed at the top end of the main housing, the sealing seat is supported on one side of the bottom seat facing the accommodating cavity, a vent tube that communicates the atomizing cavity with the smoke outlet is provided in the main housing, the portion of the interior of the main housing other than the atomizing assembly, the sealing seat and the vent tube defines the liquid storage cavity, the air inlet hole is provided on the bottom seat, the atomizing assembly comprises an atomizing cover with an open end supported on the sealing seat, the plugging assembly comprises a sealing member slidably disposed in the air inlet passage and a pulling member configured for pulling the sealing member along an axial direction of the atomizing cover to remove the sealing member away from the air inlet passage, one end of the pulling member is connected to the sealing member, the bottom seat is correspondingly provided with an opening for the other end of the pulling member to pass through, and the other end of the pulling member passes through the opening to extend to the outside the main housing.

2. The atomizer according to claim 1, wherein the plugging assembly comprises a sealing member slidably disposed in the air inlet passage along an axial direction of the air inlet passage and a pulling member configured for pulling the sealing member to remove the sealing member away from the air inlet passage, one end of the pulling member is connected to the sealing member, the liquid storage member is correspondingly provided with an opening for the other end of the pulling member to pass through, and the other end of the pulling member passes through the opening to extend to the outside of the liquid storage member.

3. The atomizer according to claim 2, wherein the pulling member is a pulling rod, the pulling rod comprises a long rod section extending to the outside of the liquid storage member and a connecting section connecting the long rod section with the sealing member.

4. The atomizer according to claim 3, wherein the diameter of the connecting section is smaller than the diameter of the long rod section.

5. The atomizer according to claim 1, wherein the atomizing assembly further comprises an atomizing core for generating heat to heat the aerosol-forming substrate when energized, the inner cavity of the atomizing cover forms the atomizing cavity, the atomizing core is disposed in the atomizing cavity, a closed end of the atomizing cover is provided with a smoke guiding hole, the inner cavity of the vent tube forms a smoke guiding passage that communicates the smoke guiding hole with the smoke outlet, the portion of the interior of the main housing other than the atomizing cover, the sealing seat and the vent tube defines the liquid storage cavity, the liquid inlet hole is provided on the side wall of the atomizing cover, the outer contour of the atomizing cover is in a tubular shape, the axial direction of the air inlet passage is parallel to the axial direction of the atomizing cover, a first port of the air inlet passage is communicated with the atomizing cavity, a first groove for accommodating the sealing member is provided on one side of the bottom seat facing the sealing seat, the first groove communicates the air inlet hole with a second port of the air inlet passage.

6. The atomizer according to claim 5, wherein a vent groove is provided on the sealing seat adjacent to the second port of the air inlet passage.

7. The atomizer according to claim 5, wherein a protrusion is provided on the bottom seat corresponding to the position of the air inlet passage, the protrusion is located in the first groove, so that the portion of the first groove other than the protrusion forms a liquid reservoir, the opening is provided on the protrusion, the axial direction of the opening is parallel to the axial direction of the atomizing cover, the protrusion is further recessed to form a positioning groove for accommodating and positioning the sealing member, the positioning groove is communicated with the opening.

8. The atomizer according to claim 7, wherein one side of the sealing member facing the atomizing cover is recessed to form a second groove.

9. The atomizer according to claim 8, wherein after the sealing member is removed away from the air inlet passage, the height of the top open end of the air inlet hole is higher than the height of the top open end of the second groove in the direction from the bottom seat to the smoke outlet.

10. The atomizer according to claim 8, wherein the sealing member is provided with a stopping projection for restricting the movement of the sealing member.

11. The atomizer according to claim 1, wherein the atomizer further comprises a sealing sleeve, the sealing sleeve is slidably sleeved on the bottom end of the vent tube, and when installing the atomizing assembly into the accommodating cavity and installing the bottom seat to the bottom opening of the main housing, the atomizing assembly pushes the sealing sleeve to move from a first preset position to a second preset position along the axial direction of the vent tube.

12. The atomizer according to claim 11, wherein the sealing sleeve comprises a first sleeve section for being slidably sleeved on the bottom end of the vent tube, an annular sleeve section for being resisted by the end face of one end of the atomizing assembly, and a second sleeve section for being sleeved on the one end of the atomizing assembly, the annular sleeve section connects the first sleeve section and the second sleeve section to form the sealing sleeve.

13. The atomizer according to claim 12, wherein the inner diameter of the first sleeve section is larger than the diameter of an annular hole of the annular sleeve section, so as to form a first step surface at the connection position between the first sleeve section and the annular sleeve section;

the bottom end face of the vent tube is provided with a connecting tube, the connecting tube extends from the bottom end of the vent tube toward the bottom seat, the outer diameter of the connecting tube is smaller than the outer diameter of the vent tube to form a second step surface at the connection position between the vent tube and the connecting tube;

the inner diameter of the second sleeve section is larger than the diameter of the annular hole of the annular sleeve section, so as to form a third step surface at the connection position between the second sleeve section and the annular sleeve section;

when the sealing sleeve moves to the second preset position, the second step surface abuts against the first step surface, and the third step surface abuts against the end face of the one end of the atomizing assembly.

14. An aerosol generation device, comprising an atomizer for atomizing an aerosol-forming substrate and a power supply device for supplying power to the atomizer, wherein the atomizer is the atomizer according to claim 1.

15. An atomizer for an aerosol generating device, comprising:

a liquid storage member having a liquid storage cavity configured for storing an aerosol-forming substrate, wherein the liquid storage member is provided with a smoke outlet and an air inlet hole;

a sealing seat disposed in the liquid storage member, wherein the sealing seat is provided with an air inlet passage;

an atomizing assembly disposed in the liquid storage member and configured to atomize the aerosol-forming substrate to form smoke, wherein an atomizing cavity is provided inside the atomizing assembly, the atomizing assembly is provided with a liquid inlet hole that communicates the liquid storage cavity with the atomizing cavity, the atomizing cavity is communicated with the smoke outlet;

a plugging assembly configured to seal the air inlet passage to block the communication between the atomizing cavity and the air inlet hole before the aerosol generating device is put into use, wherein the plugging assembly is slidable relative to the sealing seat, when the aerosol generating device is put into use, the plugging assembly is caused to be removed away from the air inlet passage such that the air inlet passage communicates the atomizing cavity with the air inlet hole;

wherein the plugging assembly comprises a sealing member slidably disposed in the air inlet passage and a pulling member configured for pulling the sealing member to remove the sealing member away from the air inlet passage, one end of the pulling member is connected to the sealing member, and the liquid storage member is provided with an opening for the other end of the pulling member to pass through and extend to the outside the liquid storage member, when the aerosol generating device is put into use, an external force is used to pull the pulling member to enable the sealing member to slide in the air inlet passage and finally be removed away from the air inlet passage;

the liquid storage member comprises a main housing having the liquid storage cavity and a bottom seat installed at a bottom opening of the main housing, the sealing seat is received in main housing and supported on the bottom seat, a vent tube that communicates the atomizing cavity with the smoke outlet is provided in the main housing, the opening and the air inlet hole are provided on the bottom seat;

a protrusion is provided on the bottom seat corresponding to the position of the air inlet passage, the protrusion is recessed to form a positioning groove for accommodating and positioning the sealing member, the positioning groove is communicated with the opening, the sealing member is directly positioned in the positioning groove after being removed away from the air inlet passage.

16. The atomizer according to claim 15, wherein the pulling member is a pulling rod, the pulling rod comprises a long rod section extending to the outside of the liquid storage member and a connecting section connecting the long rod section with the sealing member, and the diameter of the connecting section is smaller than the diameter of the long rod section.

* * * * *